US006923594B2

(12) United States Patent
Sovik et al.

(10) Patent No.: US 6,923,594 B2
(45) Date of Patent: Aug. 2, 2005

(54) PAVEMENT RAMP EDGE MAKING

(75) Inventors: Robert A. Sovik, Clifton Park, NY (US); Richard N. Hosterman, Buskirk, NY (US)

(73) Assignee: TransTech Systems, Inc., Schenectady, NY (US)

( * ) Notice: Subject to any disclaimer, the term of this patent is extended or adjusted under 35 U.S.C. 154(b) by 0 days.

(21) Appl. No.: 10/426,143

(22) Filed: Apr. 29, 2003

(65) Prior Publication Data

US 2004/0218977 A1 Nov. 4, 2004

(51) Int. Cl.[7] ..... E01C 19/22
(52) U.S. Cl. ..... 404/96; 404/104; 404/118
(58) Field of Search ..... 404/96, 101, 104, 404/118, 98

(56) References Cited

U.S. PATENT DOCUMENTS

| | | | | |
|---|---|---|---|---|
| 2,311,286 A | | 2/1943 | Tufts | |
| 3,108,518 A | | 10/1963 | O'Connor, Jr. | |
| 3,398,663 A | | 8/1968 | Matich | |
| 3,625,121 A | | 12/1971 | Blumer et al. | |
| 4,027,990 A | | 6/1977 | Merrill | |
| 4,068,969 A | | 1/1978 | Beach et al. | |
| 4,181,449 A | | 1/1980 | Lenker | |
| 4,818,140 A | | 4/1989 | Carlson | |
| 5,051,026 A | | 9/1991 | Sovik | |
| 5,088,854 A | | 2/1992 | Sovik | |
| 5,213,442 A | | 5/1993 | Sovik | |
| 5,336,019 A | | 8/1994 | Hollon et al. | |
| 5,344,254 A | | 9/1994 | Sartain | |
| 5,362,176 A | | 11/1994 | Sovik | |
| 5,924,819 A | * | 7/1999 | Breidenbach | 404/96 |
| 5,997,270 A | * | 12/1999 | LaBonte | 425/64 |
| 6,106,192 A | * | 8/2000 | Hargis et al. | 404/101 |
| 6,238,134 B1 | | 5/2001 | Sovik | |
| 6,238,136 B1 | | 5/2001 | Sovik et al. | |
| 6,270,284 B1 | | 8/2001 | Sovik | |
| 6,273,636 B1 | * | 8/2001 | Johanpeter | 404/104 |
| 6,283,672 B1 | | 9/2001 | Sovik | |
| 6,709,195 B2 | * | 3/2004 | Piccoli et al. | 404/98 |

FOREIGN PATENT DOCUMENTS

| | | |
|---|---|---|
| CA | 990565 | 6/1976 |
| DE | 2113358 | 9/1972 |
| EP | 0 027 164 | 4/1981 |
| GB | 1 560 469 | * 2/1980 |

OTHER PUBLICATIONS

Humphreys et al., "The Elimination or Mitigation of Hazards Associated with Pavement Edge Dropoffs During Roadway Resurfacing", Feb. 1994, pp. 1–20.

Road Injury Prevention & Litigation Journal, "Alabama County Must Show a Jury That Four–Inch to Six–Inch Pavement Edge Dropoff Is A Reasonably Safe Condition", Dec. 2001, TranSafety, Inc., pp. 1–6, http://www.usroads.com/journals/rilj/0112/ri011202.htm.

Technology News, "Preventing Dangerous Edge Drop–Offs", Sep.–Nov. 2001, p. 7.

Hazards of Pavement Edge Dropoff, Public Works, Dec. 1994, "The Hazards of Pavement Edge Dropoff", Section: vol. 125, No. 13, p. 38, ISSN: 0033–3840, pp. 1–4.

* cited by examiner

*Primary Examiner*—Gary S. Hartmann
(74) *Attorney, Agent, or Firm*—Spencer K. Warnick; Hoffman, Warnick & D'Alessandro LLC

(57) ABSTRACT

A pavement ramp edge maker, paving machine and related method are provided for generating a pavement edge ramp that is equal to or less than approximately 45° relative to a surface upon which the ramp is formed. The edge maker generates a ramp that is partially compacted using a compaction surface that extends upwardly from a bottom edge of an end gate of a paving machine. When the pavement mat is compacted, the resulting ramp has an angle that is equal to or less than approximately 45° relative to a surface upon which the ramp is formed.

22 Claims, 5 Drawing Sheets

PAVEMENT RAMP EDGE MAKING

BACKGROUND OF THE INVENTION

1. Technical Field

The present invention relates generally to paving material, and more particularly, to a pavement ramp edge maker, paving machine and related method.

2. Related Art

Typically, screed pavers include a self-propelled paving machine having a hopper for receiving paving material, e.g., asphalt, from a truck so that the truck progressively dumps its load of paving material into the hopper. A conveyor system on the paving machine transfers paving material from the hopper rearwardly for discharge onto the roadbed in front of transversely arranged screw augers, which spread the material laterally in front of a main screed. This main screed functions to compress and level the paving material distributed by the augers to give a smooth finished road surface. The height and attack angle of the main screed may be varied to control the depth and surface of the pavement mat. The main screed may also include screed extenders to allow for a wider pavement mat to be laid. Subsequently, the paving material is compacted in position by, for example, a rolling machine or tamping machine.

A safety problem generated by basic paving machines are drop off edges that are left at a side or an end of a mat of paving material. Drop off edges are a safety problem because vehicles may catch a side of a tire on them, causing the vehicle to lose control. Drop off edges may range in size from a half inch to more than 2 inches, and may exist prior to and after compaction. Drop off edges can be found in highways, secondary roadways, parking areas, driveways, drainage sections, and a variety of other locations. The inherent safety issues generated by drop off edges have been identified in a report by the American Automobile Association's (AAA) Foundation for Traffic Safety that was prepared by the Transportation Center at the University of Tennessee entitled, "The Elimination or Mitigation of Hazards Associated with Pavement Edge Dropoffs During Roadway Resurfacing." In addition, evidence of the road edge drop-off safety problems is provided by the large number of lawsuits filed against cities, counties and states as reported in the Road Injury Prevention & Litigation Journal.

Drop off edges may be generated during paving at, among other areas, two notable situations. First, drop off edges are frequently generated when paving multiple active traffic lanes, where it is oftentimes impossible to pave two or more lanes in a short time span. The inability to pave two or more lanes quickly may be due to a variety of reasons, e.g., traffic, equipment shortages, etc. In this case, a drop off edge is oftentimes left between a first active traffic lane over which a new pavement mat has been laid and a second active traffic lane upon which new pavement has yet to be laid. One approach for solving this type drop off edge is disclosed in U.S. Pat. Nos. 6,238,134, 6,238,136, 6,270,284 and 6,283,672. In each of these devices, a pavement edger is fixedly mounted to a main screed or screed extension of the paving machine, and moves as an integral unit with the main screed. The pavement edger generates a stepped tapered ramp having a highly compacted step and a highly compacted upper portion of the tapered ramp. The ramp eases a vehicle's transition over the drop off edge and solves a number of paving problems relative to laying the next lane's mat.

Second, referring to FIG. 1, a drop-off edge 10 may be generated between a newly repaved area 12 and an adjacent non-repaved area 14. Non-repaved area 14 may be, for example, an emergency lane surface 18 of a main highway, a shoulder 18 of a secondary road, an unpaved area 18, etc.

In any event, the side of pavement terminates as a drop off edge 10 having an inclination $\lambda$ greater than 45°, which is generally considered an unsafe inclination. This type drop off edge oftentimes poses a significant safety problem because of obstacles such as trees, guard rails, etc., that may exist proximate the non-repaved area 14.

In a worst-case scenario, this type drop off edge 10 is not corrected and the current non-repaved area 14 is left as is. One approach to diminish this type drop off edge, however, has been to spread gravel 20 from a top edge 22 of the new pavement mat 16 to the non-repaved area surface 18. Unfortunately, this approach does not provide a permanent solution since the gravel eventually loosens and is thrown off the road. Further, this approach is fairly expensive since it requires additional passes over the area.

Ideally, a remedy for roadside drop off edge 10 should be provided during paving because each re-visitation to a site costs time and money. One approach used during paving has been to provide a strike off on an end of the paving machine screed to form a ramp. A strike off is a vertical plate attached to the screed or an opening in the screed that scrapes a ramp into the paving material passing thereunder. Unfortunately, a strike off does not adequately solve this type drop off edge because it provides hardly any compaction, which permits the ramp to be readily torn apart. In addition, a strike off tends to tear the edge of the mat causing a non-straight and disfigured pavement edge. Tearing of the edge of the mat also reduces the integrity of the mat, which decreases the life of the pavement.

The pavement edger described in the above-identified patents is impracticable relative to a drop off edge 10 adjacent a non-repaved area 14 for a number of reasons. First, the pavement edger is coupled to a main screed or screed extension of a paving machine. As a result, the pavement edger is incapable of following undulations that are common in non-repaved traffic areas. Second, the ramp generated includes vertical edges for mating with subsequent pavement mats. This ramp, although significantly better than an inclined drop off edge 10, is not designed to be a permanent remedy to drop off edge 10.

In view of the foregoing, there is a need in the art for a pavement edge maker that addresses the problems with the related art.

SUMMARY OF THE INVENTION

A pavement ramp edge maker, paving machine and related method are provided for generating a pavement edge ramp that is equal to or less than approximately 45° relative to a surface upon which the ramp is formed. The ramp reduces safety problems relative to drop off edges adjacent a non-repaved area, and increases the life of the pavement by providing a compacted edge. The edge maker generates a ramp that is partially compacted. When the pavement mat is compacted, the resulting ramp has an angle that is equal to or less than approximately 45° relative to a surface upon which the ramp is formed.

A first aspect of the invention is directed to a pavement ramp edge maker comprising: a compaction member have a compaction surface for partially compacting paving material received thereby into a ramp; a coupling device for coupling the compaction member to a vertically self-adjusting end gate of a paving machine, wherein the compaction surface is set at an edge angle such that a final angle of the ramp after compaction is less than or equal to approximately 45° relative to a surface upon which the ramp is formed.

A second aspect of the invention is directed to a paving machine comprising: a screed for distributing paving material during paving; a vertically self-adjusting end gate coupled to the screed; and a pavement ramp edge maker including: a compaction member including a compaction surface for partially compacting paving material received thereby to form a ramp; a coupling device for coupling the compaction member to the vertically self-adjusting end gate, wherein the compaction surface is set at an edge angle such that a final angle of paving material after compaction is less than or equal to approximately 45° relative to a surface upon which the ramp is formed.

A third aspect of the invention is directed to a method of forming a paving material ramp edge comprising: forming a paving material mat and a partially-compacted ramp adjacent the paving material mat, the partially-compacted ramp having an angle such that a final angle of the partially-compacted ramp after compaction is less than or equal to approximately 45° relative to a surface upon which the pre-compacted ramp is formed; and compacting the paving material mat to form the final angle of the partially-compacted ramp.

The foregoing and other features of the invention will be apparent from the following more particular description of embodiments of the invention.

BRIEF DESCRIPTION OF THE DRAWINGS

The embodiments of this invention will be described in detail, with reference to the following figures, wherein like designations denote like elements, and wherein.

DETAILED DESCRIPTION OF THE INVENTION

A pavement ramp edge maker, paving machine and related method are provided for generating a pavement edge ramp that is equal to or less than approximately 45 degrees relative to a surface upon which the ramp is formed. For definition purposes herein, a "mat" or "pavement mat" is considered a layer of paving material. "Paving material" is any material used for paving roadways, such as bituminous material like asphalt.

Figure 2:
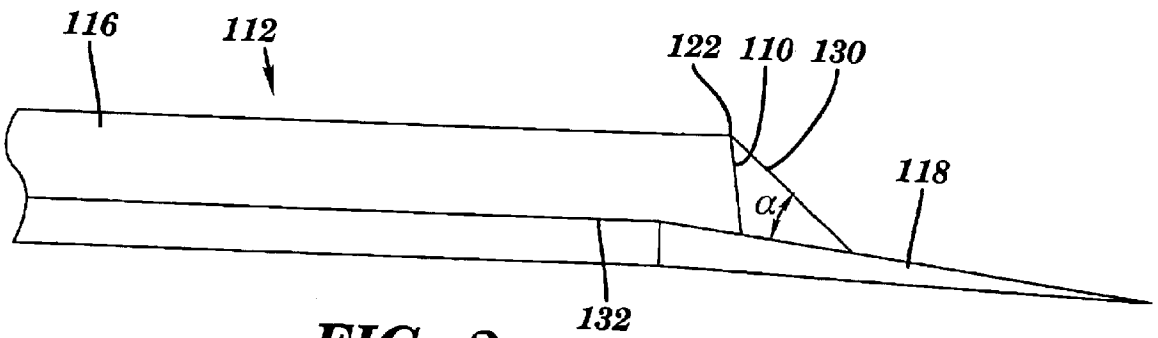
FIG. 2 shows a ramp according to the invention.

Referring to FIG. 2, a drop off edge 110 adjacent a non-repaved area 114 is shown. Safety issues relative to drop off edge 110, however, have been addressed by the inclusion of a compacted ramp 130 made according to the invention. Drop off edge 110, as discussed above, is generated when a new pavement mat 116 is laid over a re-paving area 132. Adjacent re-paving area 132 is a non-repaved area or surface 118, which will not receive new pavement mat 116 thus generating drop off edge 110. As used herein, "non-repaved surface" 118 is an area that is not receiving new pavement mat 116 it may or may not have been previously paved. Non-repaved surface 118 may be angled relative to re-paving area 132. As shown, non-repaved surface 118 is angled downwardly, for example to aid drainage away from pavement mat 116. However, where in-road drainage is available, non-repaved surface 118 may be inclined upwardly relative to pavement mat 116 to direct drainage between pavement mat 116 and surface 118.

Figure 3:
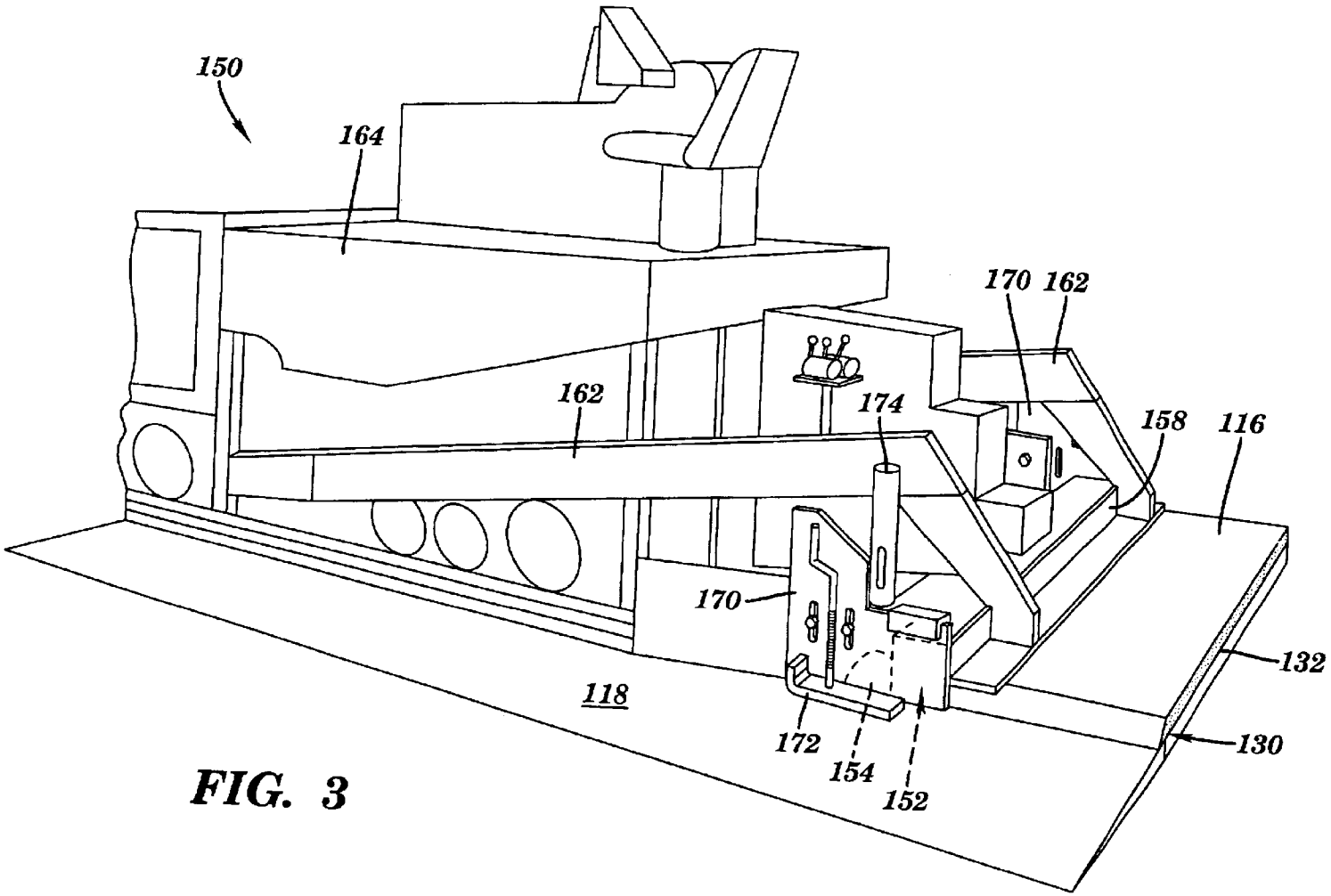
FIG. 3 shows a perspective view of a paving machine equipped with a pavement ramp edge maker according to the invention.

Turning to FIG. 3, an illustrative paving machine 150 equipped with a pavement ramp edge maker 152 (hereinafter "edge maker") of the present invention is illustrated. Paving machine 150 operates to spread and grade paving material 154, e.g., a paving road mix such as asphalt, etc., on re-paving area 132 to form pavement mat 116 with a compacted ramp 130 along one side. Paving machine 150 has a rear main screed 158. Elevation of screed 158 may be adjusted of a pair of tow arms 162 pivotally connected to a supporting frame 164. Asphalt mix carried by paving machine 150 is spread laterally in front of screed 158 by augers (not shown), which are spaced forwardly of screed 158. Paving machine 150 may also include an optional screed extender 168 (FIG. 4) to extend screed 158.

Paving machine 150 also includes a vertically self-adjustable end gate 170 (hereinafter "end gate") at each end of screed 158, as is commonly known in the art. Each end gate 170 may include a vertically adjustable sled 172, as is conventional, to support end gate 170 as it traverses surface 118. Each end gate 170 follows the contours of surface 118, and may be biased downwardly by a biasing mechanism 174, such as a spring loaded or hydraulically powered, suspension to maintain contact with surface 118.

Figure 4:
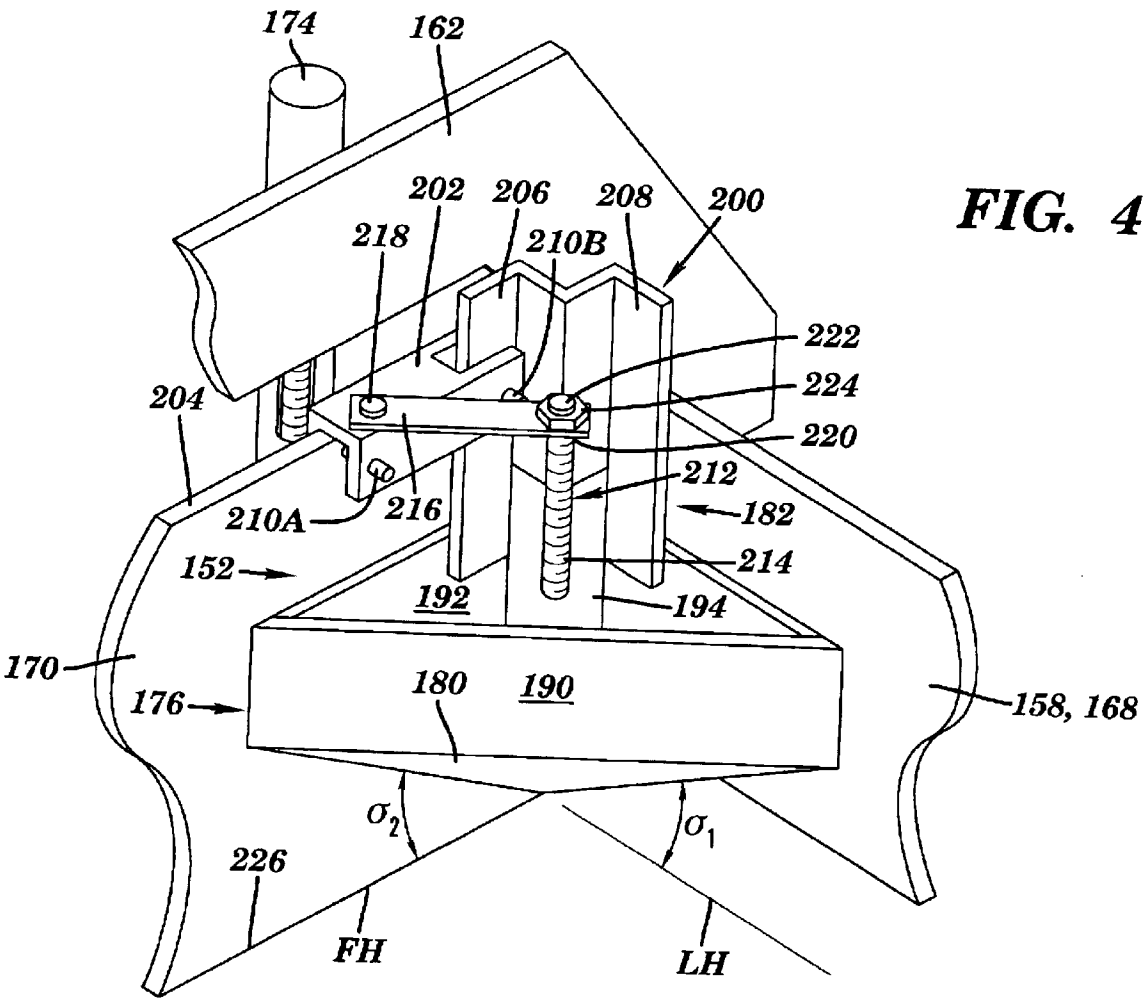
FIG. 4 shows a front perspective view of the pavement ramp edge maker.

Referring to FIG. 4, edge maker 152 is illustrated in more detail. In one embodiment, the parts of edge maker 152 are constructed of steel plate of sufficient gauge to withstand the rigors of paving. It should be recognized, however, that other materials may also be used. Edge maker 152 includes a compaction member 176 including a compaction surface 180 for compacting paving material (not shown) received thereby, and a coupling device 182 for coupling compaction member 176 to one of end gates 170. Edge maker 152 moves vertically with end gate 170, and is not connected to screed 158 or screed extension 168. Compaction member 176 also includes a paving material directing member 190 and a pair of support members 192 for positioning compaction surface 180. Compaction member 176 may also include a brace member 194. Paving material directing member 190 directs paving material toward compaction surface 180, and prevents paving material from flowing behind compaction surface 180. In one embodiment, compaction surface 180 is shaped substantially like an isosceles triangle, and paving material directing member 190 is a substantially vertical plate that is set at an angle of approximately 45° relative to end plate 170.

Coupling device 182 includes a mounting post 200 coupled to compaction member 176, and a mounting clamp 202 for coupling the mounting post to end gate 170. In one embodiment, mounting post 200 is provided as a W-shaped member, and mounting clamp 202 is a U-shaped channel. Mounting clamp 202 is capable of receiving one of a first post section 206 and a second post section 208 of mounting post 200, and a top edge 204 of end gate 170. Mounting clamp 202 receives a number of threaded fasteners 210A, 210B that can be tightened to hold mounting post 200 (first post section 206 as shown) against end gate 170.

Figure 1:
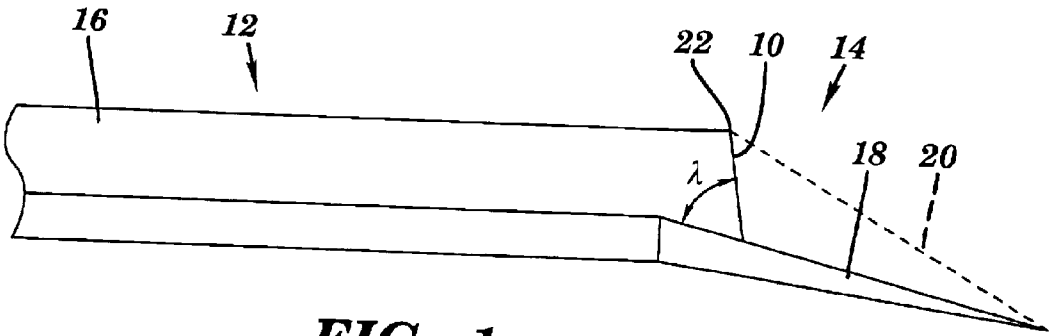
FIG. 1 PRIOR ART
FIG. 1 shows a prior art drop off edge adjacent a non-repaved area.

Coupling device 182 may also include a vertical adjuster 212 for adjusting the vertical position of compaction member 176 relative to end gate 170. Vertical adjustment of compaction member 176 relative to end gate 170 is advantageous to accommodate varying sizes of paving material aggregate and prevent tearing paving material mat 116 (FIGS. 1 and 3). In one embodiment, vertical adjuster 212 includes a threaded vertical adjustment member 214 (hereinafter "adjustment member") threadably coupled to compaction member 176 (e.g., via brace member 194), and an armature 216. Armature 216 couples adjustment member 214 to mounting clamp 202 at a first end 218, and rotatably receives a first end 220 of adjustment member 214 at a second end 222 thereof. Adjustment member 216 includes an engagement member 224 for turning by a user. Engagement member 224 may be any type of device for grasping and turning by a user, e.g., a bolt, a crank, screw head, etc. Brace member 194 is fixedly coupled to paving material directing member 190 and mounting post 200.

In order to vertically adjust compaction member 176, a user loosens threaded fastener 210B and turns engagement member 224, which turns adjustment member 214. As adjustment member 214 turns, the vertical position of compaction member 176 relative to end gate 170 changes because of adjustment member's 214 threaded connection at brace member 194. Once in a desired position, a user re-tightens threaded fastener 210B to couple mounting post 200 to end gate 170. While the adjustment range may vary to accommodate all varieties of paving material, in one embodiment, compaction surface 180 is set to be slightly (less than 0.5-inch) above a bottom edge 226 of end gate 170 and has an adjustment range between approximately 12 mm and approximately 24 mm.

It should be recognized that a variety of other mechanisms for mounting compaction member 176 to end gate 170 and for vertically adjusting compaction member 176 are possible, and are considered within the scope of the invention. Other possibilities for vertical adjustment include, for example, a pin and a plurality of holes, a slot and positioning bolt, etc. In addition, alterations of the described embodiment are also possible and considered within the scope of the invention.

Coupling device 182 allows easy and quick installation of edge maker 152, and also allows mounting of edge maker 152 on either one of end gates 170. In order to switch from the end gate 170 shown in FIG. 4 to the other end gate (FIG. 3), mounting clamp 202 is removed from end gate 170 (i.e., by loosening threaded fasteners 210A, 210B), which releases first mounting section 206. Next, edge maker 152 is rotated to match the position of the other end gate (FIG. 3) and screed 158 or screed extension 168. Mounting clamp 202 is then pivoted about its pivotal connection with first end 218 of armature 216, and armature 216 is pivoted about its pivotal connection with adjustment member 214 toward second mounting section 208. Mounting clamp 202 can then receive second mounting section 208 and a top edge of the other end gate (FIG. 3). Threaded fasteners 210A, 210B are then tightened (into threaded openings on the other side of clamp 202 from that shown) to hold compaction member 176 to the other end gate (FIG. 3). While a particular coupling device has been described, it should be recognized that a variety of other coupling devices (e.g., bolting to end gate 170) can be used and are considered within the scope of the invention.

Figure 5A:
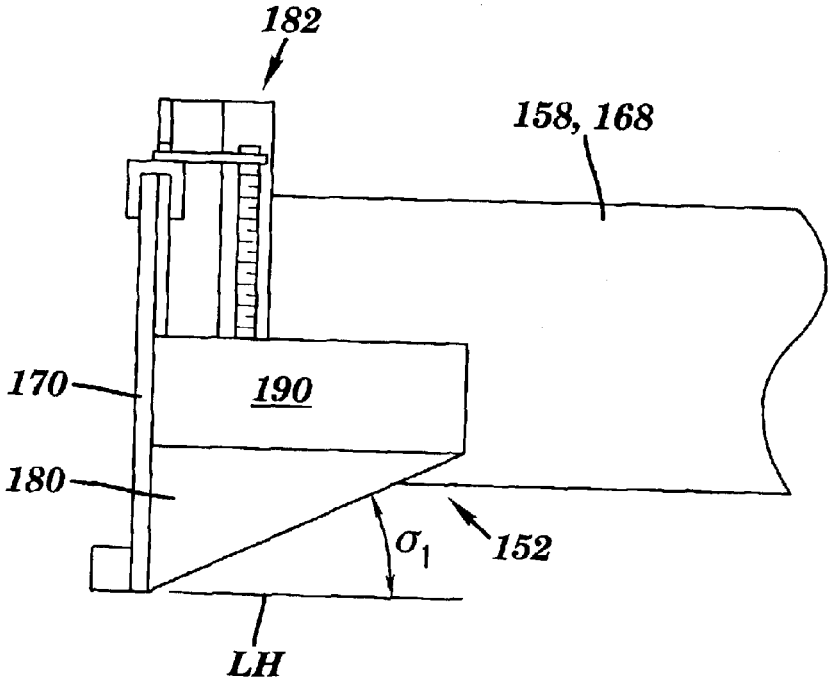
FIG. 5A shows a front view of the pavement ramp edge maker.
Figure 5B:
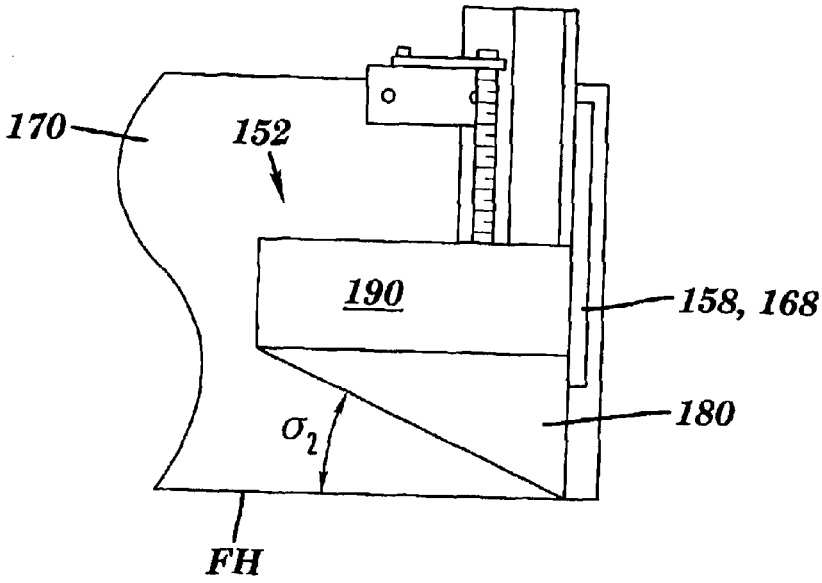
FIG. 5B shows a side view of the pavement ramp edge maker.

Referring to FIGS. 4, 5A and 5B collectively, details of compaction surface 180 will be described. Assuming compaction surface 180 is provided as a flat surface, compaction surface 180 is set at a position determined, in part, by an edge angle $\sigma_1$ and a compaction angle $\sigma_2$. Edge angle $\sigma_1$ extends between compaction surface 180 and surface 118 (FIGS. 2 and 3) upon which the paving material is laid, and in a lateral direction (LH) from end gate 170. Compaction angle $\sigma_2$ also extends between compaction surface 180 (FIGS. 2 and 3) and surface 118 upon which the paving material is laid, but in a direction of travel (FH) of end gate 170. In one embodiment, edge angle $\sigma_1$ and a compaction angle $\sigma_2$ are substantially identical, e.g., within 0–5°. This configuration is advantageous, for example, so that a single edge maker 152 can be used on either end gate 170 of a paving machine. In particular, when the position is switched, edge maker 152 is rotated 90° (clockwise in the example shown in FIG. 4) such that edge angle $\sigma_1$ becomes the compaction angle, and compaction angle $\sigma_2$ becomes the edge angle. However, it is possible to have an edge angle $\sigma_1$ and compaction angle $\sigma_2$ that are different on a single compaction member 176, if desired. In either case, changes of angles $\sigma_1$ and $\sigma_2$ may be advantageous to address different settings, for example, different paving materials, different end gates, different temperatures, etc. In this case, a set of compaction members 176 having different settings or an adjustable compaction surface 180 may be advantageous for flexibility. It is also possible to alter the shape of compaction surface 180, if desired. In one embodiment, compaction angle $\sigma_2$ is less than approximately 45° to provide compaction to paving material exposed thereto.

Figure 6:
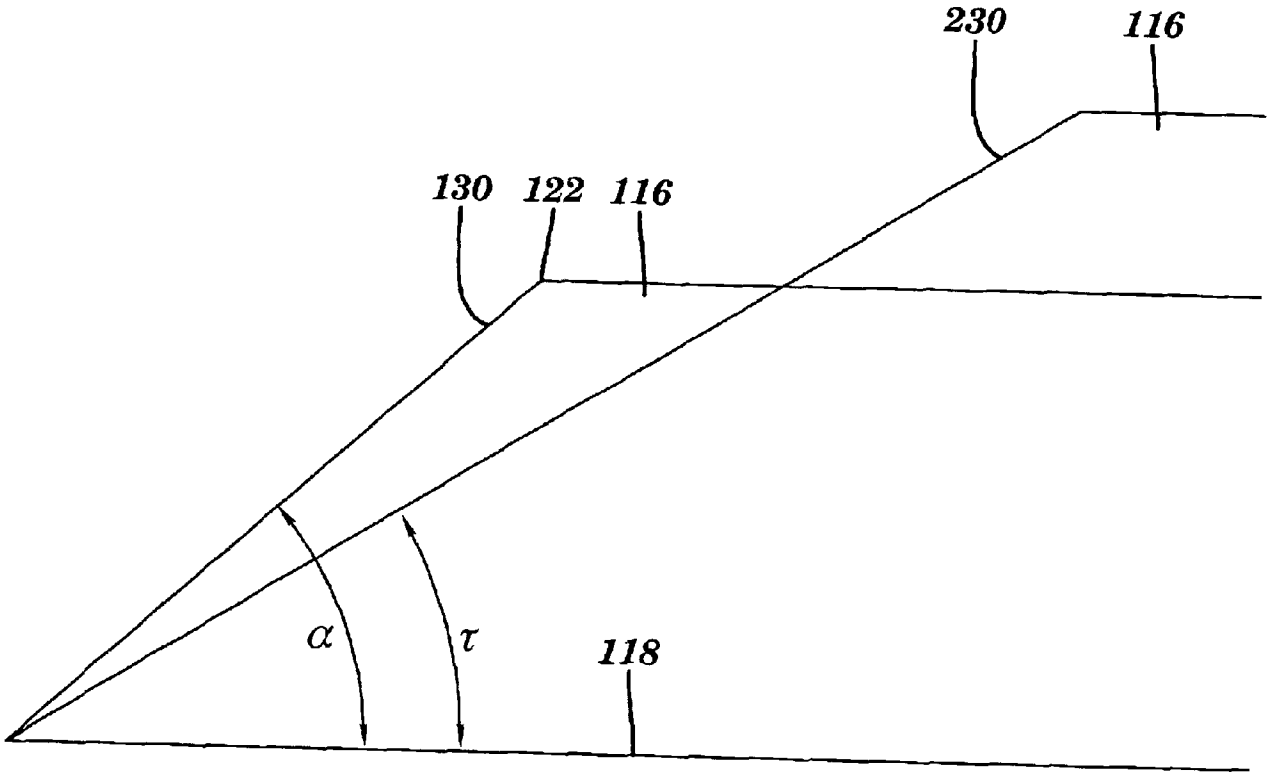
FIG. 6 shows a profile of a pre-compaction ramp and the ramp of FIG. 2.

Referring to FIG. 6, a cross-sectional view of a partial-compaction ramp 230 formed by edge maker 152, and a post-compaction ramp 130 (FIG. 2 also) are illustrated. Partial-compaction ramp 230 illustrates how pavement material exits from edge maker 152 in a partially compacted form. "Partially compacted," as used herein, means more compacted than paving material exiting screed 158 or screed extension 168, but not as compacted as paving material that has been finally compacted by rolling, tamping, etc. This is in contrast to ramps that are formed by strike offs, which have no or very little compaction. Edge angle $\sigma_1$ (FIG. 4) determines an angle $\tau$ of a partial-compaction ramp 230 prior to final compaction. Edge angle $\sigma_1$ (FIG. 4) is set such that a final compaction angle $\alpha$ (FIGS. 2 and 6) of paving material is less than or equal to approximately 45° relative to surface 118 upon which the paving material is laid. As used herein, "final compaction angle" refers to the angle of the ramp relative to surface 118 upon which the paving material is laid after compacting by, for example, rolling, tamping, etc. In one illustrative embodiment, edge angle $\sigma_1$ (and hence angle $\tau$) is set at approximately 35° relative to horizontal. However, a variety of angles are possible. Final compaction ramp 130 illustrates how the height of pavement mat 116 is reduced by compaction, e.g., by rolling, and a final compaction angle $\alpha$ of the ramp is greater than angle $\tau$ after final compaction. A final compaction angle $\alpha$ of less than or equal to approximately 45° provides a sufficiently gradual transition from a top edge 122 of compacted paving material mat 116 to surface 118 such that the risk of vehicle control loss is greatly reduced.

Edge maker 152, in one embodiment, can accommodate pavement lifts of 1 to 4 inches compacted (or 1.5 to 5.5 inches uncompacted height). Since edge maker 152 is coupled to vertically self-adjusting end gate 170, it can automatically compensate for height variations between new pavement mat 116 and surface 118. Further, edge maker 152 insures that a maximum deviation from straight-line edge of pavement mat 116 does not vary more than 1.5 inches per inch of depth change after compaction. Further, ramp 130 does not require any special rolling devices to achieve a density level adequate for an operating life equal to that of paving material mat 116.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

For example, paving machine 150 (FIG. 30 is meant only to be illustrative. The pavement edge maker of the invention may be applied to a variety of paving machines.

What is claimed is:

1. A pavement ramp edge maker comprising:

a compaction member having a compaction surface for partially compacting paving material received thereby into a ramp, the compaction surface having:

a) a compaction angle relative to a direction of travel such that the compaction surface includes a lower edge that contacts an end gate of a paving machine above a bottom edge of the end gate and extends upwardly and forwardly relative to the bottom edge, and b) an edge angle relative to a lateral direction such that a final angle of the ramp after compaction is less than or equal to approximately 45° relative to a surface upon which the ramp is formed; and a coupling device for coupling the compaction member to the paving machine.

2. The pavement ramp edge maker of claim 1, wherein the coupling device includes:

a mounting post coupled to the compaction member; and a mounting clamp coupling the mounting post to the end gate.

3. The pavement ramp edge maker of claim 2, wherein the coupling device further includes a vertical adjuster including:

a threaded vertical adjustment member threadably coupled to the compaction member for vertical adjustment of the compaction member relative to the end gate; and an armature coupling the threaded adjustment member to the mounting clamp.

4. The pavement ramp edge maker of claim 3, wherein the paving machine includes two end gates, and the mounting clamp is pivotal via the armature between a first position in which the mounting clamp mounts a first mount section of the mounting post to one of the end gates, and a second position in which the mounting clamp mounts a second mount section of the mounting post to the other of the end gates.

5. The pavement ramp edge maker of claim 1, wherein the compaction member further includes a paving material directing member for directing paving material toward the compaction surface.

6. The pavement ramp edge maker of claim 5, wherein the paving material directing member is a plate that is set at an angle of approximately 45° relative to the end gate.

7. The pavement ramp edge maker of claim 5, wherein the compaction member further includes a pair of support members coupled to the compaction surface and the paving material directing member.

8. The pavement ramp edge maker of claim 1, wherein the compaction surface is substantially isosceles triangular shaped.

9. The pavement ramp edge maker of claim 1, wherein the compaction angle is less than approximately 45°.

10. The pavement ramp edge maker of claim 9, wherein the edge angle and the compaction angle are substantially identical.

11. The pavement ramp edge maker of claim 9, wherein the edge angle and the compaction angle are approximately 35°.

12. The pavement ramp edge maker of claim 1, wherein the end gate includes a bias mechanism to bias the end gate downwardly.

13. The pavement ramp edge maker of claim 1, wherein a bottom surface of one of a screed and a screed extension of the paving machine intersects the compaction surface intermediate ends of the compaction surface.

14. The pavement ramp edge maker of claim 1, wherein a bottom surface of one of a screed and a screed extension of the paving machine intersects the compaction surface intermediate ends of the compaction surface.

15. A paving machine comprising:

a screed for distributing paving material during paving;

an end gate coupled to the screed; and a pavement ramp edge maker including:

a compaction member including a compaction surface for partially compacting paving material received thereby to form a ramp, the compaction surface having a lower edge that contacts an end gate of a paving machine above a bottom edge of the end gate and extends upwardly and forwardly relative to the bottom edge; and a coupling device for coupling the compaction member to the end gate, wherein the compaction surface is set at an edge angle such that a final angle of paving material after compaction is less than or equal to approximately 45° relative to a surface upon which the ramp is formed.

16. The paving machine of claim 15, wherein the edge angle is approximately 35° relative to horizontal.

17. The paving machine of claim 15, wherein the coupling device includes:

a mounting post coupled to the compaction member; and a mounting clamp coupling the mounting post to the end gate.

18. The paving machine of claim 17, wherein the coupling device further includes a vertical adjuster including:

a threaded vertical adjustment member threadably coupled to the compaction member for vertical adjustment of the compaction member relative to the end gate; and an armature coupling the threaded adjustment member to the mounting clamp.

19. The paving machine of claim 18, wherein the paving machine includes two end gates, and the mounting clamp is pivotal via the armature between a first position in which the mounting clamp mounts a first mount section of the mounting post to one of the end gates, and a second position in which the mounting clamp mounts a second mount section of the mounting post to the other of the end gates.

20. The paving machine of claim 15, wherein the compaction member further includes a paving material directing member for directing paving material toward the compaction surface.

21. The paving machine of claim 15, wherein the end gate includes a bias mechanism to bias the end gate downwardly.

22. The paving machine of claim 15, wherein a bottom surface of the screed intersects the compaction surface intermediate ends of the compaction surface.

* * * * *